United States Patent [19]

Kahelin et al.

[11] Patent Number: 4,896,646

[45] Date of Patent: Jan. 30, 1990

[54] AUTOMATED FEEDER FOR A BALL PROPELLING MACHINE

[76] Inventors: Edward W. Kahelin; Thomas C. Kahelin, both of 3921 Kitten Cir., Hamilton Beach, Calif. 92649

[21] Appl. No.: 272,827

[22] Filed: Nov. 18, 1988

[51] Int. Cl.[4] ..... F41B 15/00

[52] U.S. Cl. ..... 124/51 R; 124/50; 124/82; 221/258; 221/277; 198/463.5

[58] Field of Search ..... 124/1, 4–7, 124/41 R, 45, 49, 50, 51 R, 78, 80, 82; 273/26 D; 221/151, 153, 208, 258, 268, 277; 198/463.5

[56] References Cited

U.S. PATENT DOCUMENTS

| | | | |
|---|---|---|---|
| 1,211,738 | 1/1917 | Marty | 124/1 X |
| 2,263,811 | 11/1941 | Lipkin | 221/277 |
| 2,716,973 | 9/1955 | Desi | 124/51 RX |
| 2,729,206 | 1/1956 | Wilson | 124/78 |
| 3,254,792 | 6/1966 | Danielson et al. | 221/258 X |
| 3,878,827 | 4/1975 | Newgarden | 124/1 |
| 4,132,214 | 1/1979 | Schnurr et al. | 124/1 |
| 4,323,047 | 4/1982 | McIntosh et al. | 124/1 |
| 4,423,717 | 1/1984 | Kahelin | 124/78 |
| 4,676,504 | 6/1987 | Ponza | 273/26 D |

*Primary Examiner*—Randolph A. Reese
*Assistant Examiner*—John Ricci
*Attorney, Agent, or Firm*—George W. Finch

[57] ABSTRACT

The invention feeds balls to a connected ball propelling machine, such as those used to propel softballs and baseballs. The feeder includes a chute angled with respect to gravity so that balls loaded into an upper end thereof tend to travel through the chute but are restricted in their movement by an abutment surface. The abutment surface is formed on a bumper member extending upwardly into the chute. A rotating shaft extends across the chute in proximity to and behind the abutment surface. The shaft includes a pair of hooks extending about the bumper member so that upon rotation of the shaft, the hooks lift one ball at a time over the bumper member. This allows the lifted ball to continue its travel down the chute and into the ball propelling machine. A cam included on the shaft, and switches are used to control a motor connected to rotate shaft. By positioning the switches as desired, the feeder can be operated continuously, operated for a predetermined time, operated for a predetermined number of rotations or operated on command.

13 Claims, 2 Drawing Sheets

AUTOMATED FEEDER FOR A BALL PROPELLING MACHINE

BACKGROUND OF THE INVENTION

Many ball propelling machines are available. Some, such as McIntosh et al, U.S. Pat. No. 4,323,047; Marty, U.S. Pat. No. 1,211,738; Newgarden, Jr., U.S. Pat. No. 3,878,827; and Kahelin, U.S. Pat. No. 4,423,717; have automated feed devices. All have disadvantages which include tendencies to jam, propensities to release a ball at unforeseen times, or needless cost and complexity.

Especially when a ball propelling machine is used for commercial purposes, it is desirable to provide automated ball feeding means so that upon paying the proper fee, a customer can take batting practice without the need for active attention by batting cage Personnel. To reduce the need for labor even further, some batting cages even automate the fee paying by incorporating coin operated controls. In these batting cages, an amount of time during which balls are pitched at regular intervals or a number of pitches is sold. In any case, it is important that only a single ball is propelled at a time, and that the time of ball propulsion is predictable. Otherwise customers may be hit and injured by an unexpected pitch. It is also important that the ball feed device works reliably in the harsh commercial environment, is economical to manufacture and maintain, is trouble free, and is absolutely safe for both users and cage employees.

SUMMARY OF THE PRESENT INVENTION

The present invention is an automated ball feeder for use with ball propelling machines, primarily those installed in commercial batting cages. The feeder includes a chute tilted from horizontal about 20° to 30° so that balls inserted in the upper, inlet end thereof tend to roll out a lower, outlet end thereof. The free movement of balls through the chute is impeded by a bumper member which extends upwardly through a central slot in the base portion of the chute. The bumper has an abutment surface facing the inlet end and positioned generally at a right angle to the motion of balls down the chute. The abutment surface extends above the center of a ball in the chute which is in engagement therewith.

A motorized shaft positioned transversely in the chute just behind the abutment surface includes a pair of hooks. The hooks extend radially from the shaft and are spaced to extend on opposite sides of the bumper member during at least a portion of the rotation of the shaft. The hooks are curved and sized to engage the underside of only the ball in contact with the abutment surface. As the shaft rotates, the hooks cradle the ball and lift it over the bumper member so that the ball can continue its movement down the chute.

The rotation of the shaft can be continuous so that balls are released at uniform intervals or a cam and switch arrangement attached to the shaft can be used to stop the rotating shaft by interrupting power fed to a motor driving the shaft, at a predetermined rotative position of the shaft. Preferably the power is interrupted to stop the motor when the hooks are pointing upwardly. This directs any ball which might somehow get forced over the bumper member out of the chute where it can drop harmlessly to the floor. Thereafter, the motor which drives the shaft can be activated by a manual, normally off switch which allows one complete rotation of the shaft, by a timed switch which allows motor actuation for a predetermined length of time and/or the cam and switch can be used with a counter to supply the number of balls purchased by the customer.

It is therefore an object of the present invention to provide an economic and safe ball releasing mechanism for a ball throwing machine.

Another object is to provide a ball releasing mechanism which is adaptable to both baseballs and softballs.

Another object is to provide a ball release mechanism which is reliable and needs little if any maintenance.

These and other objects and advantages of the present invention will become apparent to those skilled in the art after considering the following detailed Specification which covers preferred embodiments of the present invention in conjunction with the accompanying drawings wherein:

DETAILED DESCRIPTION OF THE PRESENT EMBODIMENT

Figure 1:
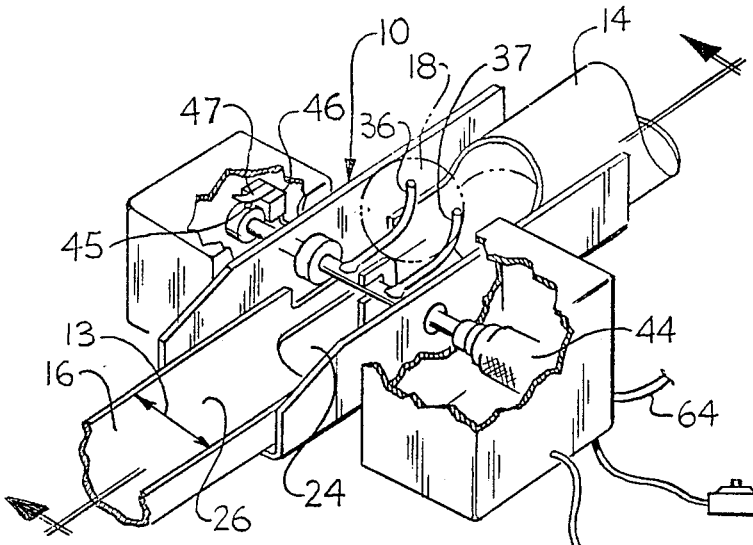
FIG. 1 is a perspective view of the present invention partially cut away and showing the mechanism part way through a ball release cycle.

Referring to the drawings more particularly by reference numbers, number 10 in FIG. 1 refers to a ball releasing mechanism constructed according to the present invention. The mechanism 10 includes a chute 12 slanted at about 20° to 30° with respect to gravity which has a predetermined cross-sectional diameter 13, a generally tubular upper input end 14 and a lower outlet end 16. Balls 18 to be propelled by a ball propelling machine, not shown, but normally attached to the outlet end 16 of the chute 12, are fed to the upper inlet end 14 by attached tubes and conveyor apparatus or similar means, also not shown. The cross-sectional diameter 13 of the chute 12 is slightly larger than twice the radii 19 of the balls 18 so that the chute 12 restricts the motion of the balls 18 to a predetermined path, yet the balls 18 roll smoothly down the path without binding in the chute 12.

Figure 2:
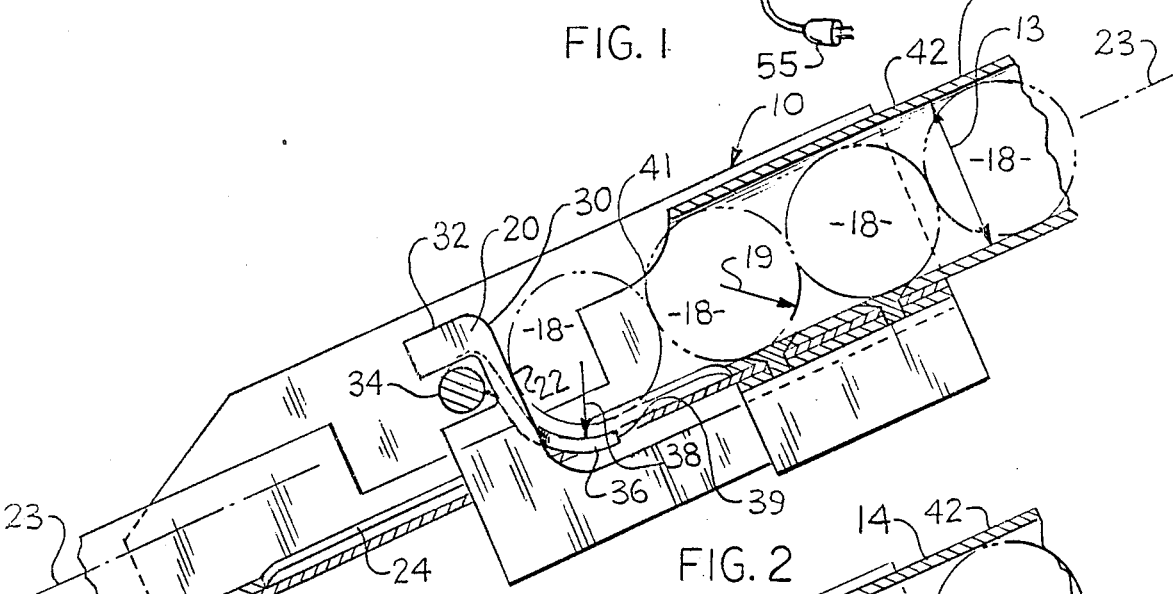
FIG. 2 is a cross-sectional view taken at FIG. 2—2 in FIG. 1 showing the positioning of the invention as it is starting to lift a ball.

As can be seen in FIG. 2, the path of the balls 18 is impeded by bumper member 20 which has an abutment surface 22 positioned generally at a right angle to the longitudinal axis 23 of the chute 12. The bumper member 20 is positioned upstandingly in the chute 12 through a slot 24 formed through the lower periphery 26 of the chute 12 and preferably is in lateral alignment with the axis 23 so minimal side loads are imparted to a ball 18 in engagement therewith. The abutment surface 22 extends upwardly into the chute 12 a distance which is greater than the radius 19 of the balls 18 to be released so that there is no tendency for an oversized or deformed ball to wedge itself over the bumper member 20 at the urging of the following balls 18. The bumper member 20 also includes a radius surface 30 and an upper surface 32, the radius surface 30 transitioning between the generally vertically extending abutment surface 22 and the upper surface 32 which extends generally parallel to the axis 23 of the chute 12.

Figure 3:
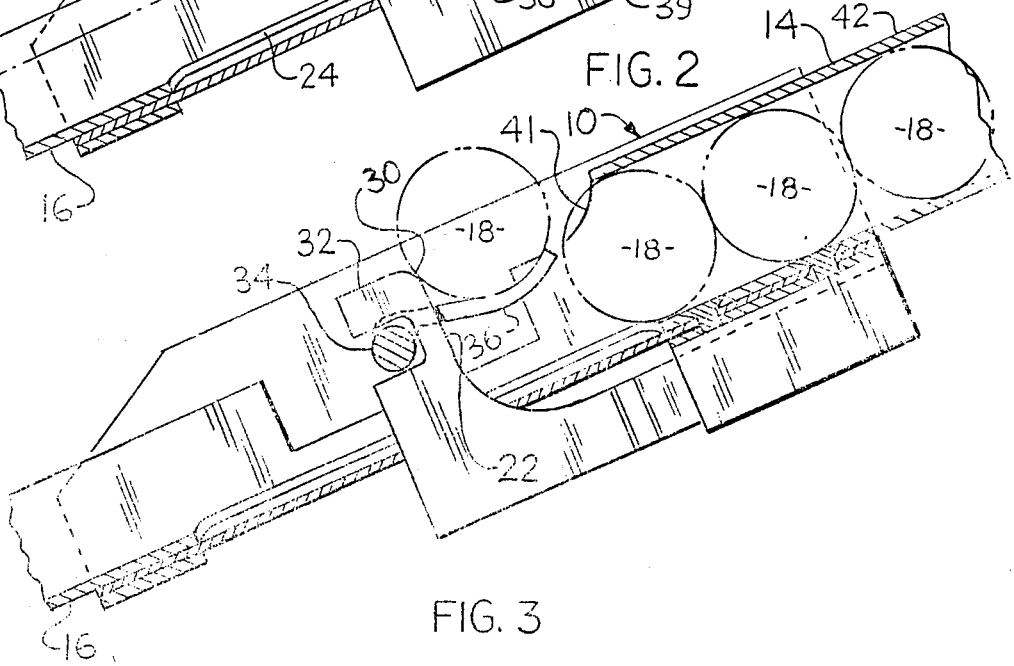
FIG. 3 is a view similar to FIG. 2 with the invention cradling a ball part way through its release cycle.
Figure 4:
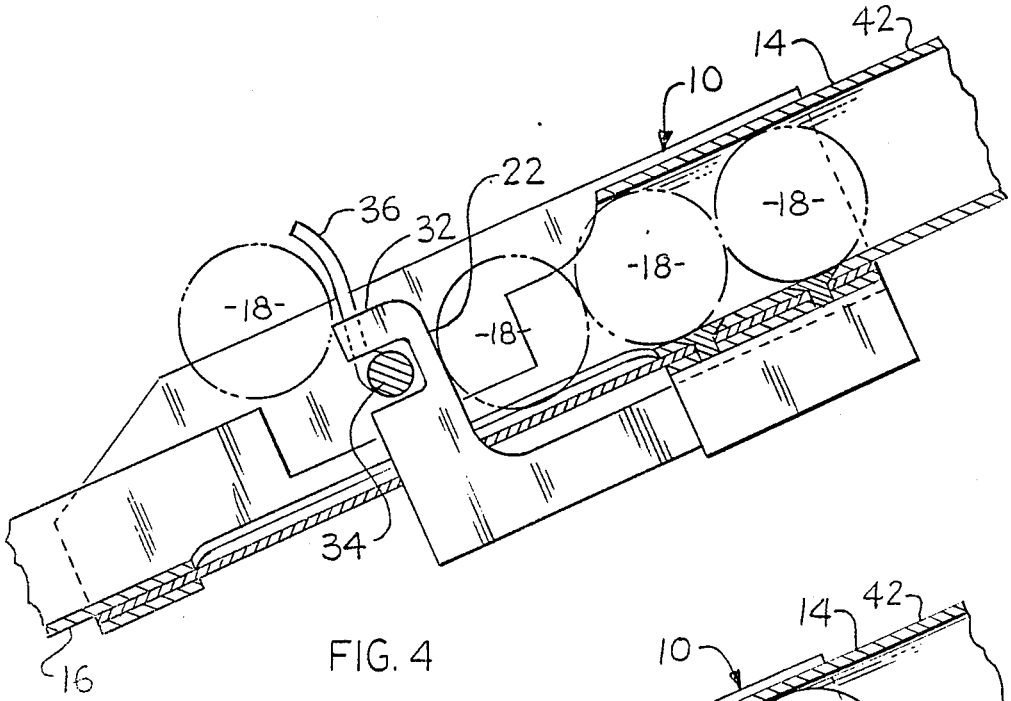
FIG. 4 is a view similar to FIGS. 2 and 3 with the invention at its moment of ball release.
Figure 5:
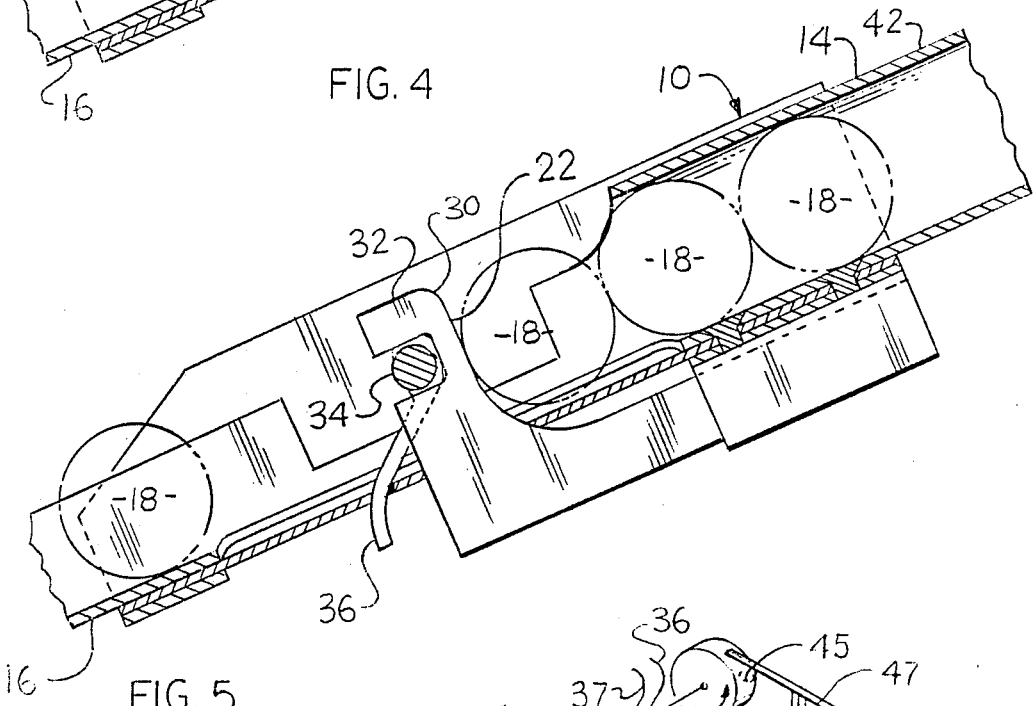
FIG. 5 shows a view similar to FIG. 2 with the released ball rolling down the chute and another ball about to start a release cycle.

A rotatable shaft 34 extends transversely across the chute 12 near but slightly down the chute 12 from the abutment surface 22. The shaft 34 includes a pair of hooks 36 and 37. The hooks 36 and 37 have radii 38 slightly larger than the radii 19 of the balls 18 and a linear length to the tips 39 thereof which is less than two radii 19. The hooks 36 and 37 are connected to the shaft 34 for rotation and act as a pair of fingers about the bumper member 20 to rotate up through the slot 24 and engage the underside 40 of a ball 18 in engagement with the abutment surface 22. As the shaft 34 rotates the hooks 36 and 37 lift the ball 18 thereon up over the bumper member 20 as it is in contact with the abutment surface 22, the radius surface 30, and the upper surface 32, as shown in FIG. 3 and 4, so that the lifted ball 18 is released down the chute 12 as shown in FIG. 5. It is important that the hooks 36 and 37 have sufficient curvature and are short enough that only one ball 18 at a time is lifted over the bumper member 20. As further assurance that only one ball 18 will be lifted, the opening 41 in the top 42 of the generally tubular, upper inlet end 14 of the chute 12 which provides clearance for a lifted ball 18, is formed close enough to the abutment surface 22 that only the ball 18 being lifted by the hooks 36 and 37 is clear of the top 42. As can be seen in FIG. 3 the underside 43 of hooks 36 and 37 cooperate with the opening 41 to prevent the next ball 18 from early release. As can be seen in FIG. 4, when one ball 18 is lifted out of the way, the next ball 18 rolls into engagement with the abutment surface 22 to await lifting by the hooks 36 and 37.

Figure 6:
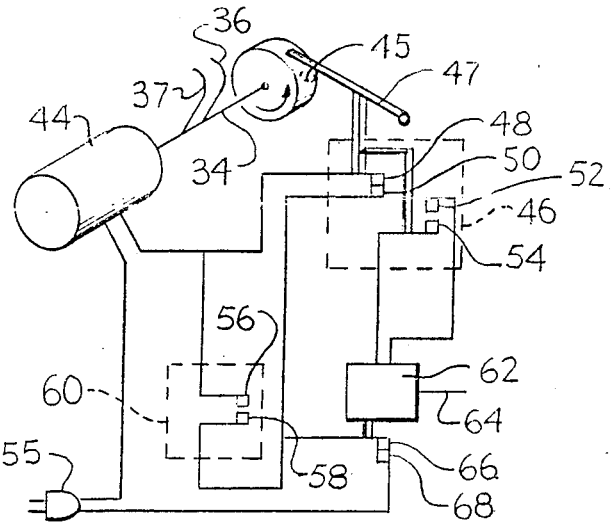
FIG. 6 is a diagrammatic representation of typical control means for the present invention.

The shaft 34 can be driven by any suitable motor or gear motor combination capable of driving it at a desired rotation rate which is usually about 10 RPM. Such a gear motor 44 is shown in FIGS. 1 and 6. A limited torque permanent split capacitor gear motor such as the 3M154 manufactured by W. W. Granger of Chicago is particularly suitable because it will stall before applying enough torque to injure an employee who puts his hand in the mechanism 10, can be stalled indefinitely without burning out, and yet can produce enough torque to operate the mechanism 10.

If it is desired to continuously provide balls 18 to an attached ball propelling machine at about ten balls/minute, the gear motor 44 is just allowed to run. However, in many instances it is desired to control the release of balls 18 either to a specific count, for a specific length of time, or at intervals longer than six seconds. Many suitable control devices are possible, the means disclosed for doing this including a cam member 45 connected to the shaft 34 for rotation therewith. The cam member 45 operates a switch 46 by means of a finger 47 moved thereby. As shown in FIG. 6, the switch 46 has both normally closed contacts 48 and 50 and normally open contacts 52 and 54. When the contacts 48 and 50 are closed, power from plug 55 is applied to the gear motor 44 and the shaft 34 rotates until the cam member 45 lifts the finger 47 opening the contacts 48 and 50 and thereby stopping the gear motor 44. The rotation of the shaft 34 can be restarted by closing the contacts 56 and 58 inside switch 60 which can be either a momentary on switch when used to release a ball 18 on demand or an on/off switch when used to turn on and off an otherwise continuously operating mechanism 10. The contacts 56 and 58 can accomplish this action because they are in parallel with the contacts 48 and 50. The normally open contacts 52 and 54 within the switch 46 can be used to apply ball count signals to a counter 62. The counter 62 can be set to allow a certain number of counts either through a manual or electrical input 64 which keeps contacts 66 and 68, in series with contacts 48 and 50, and 56 and 58, closed to energize the mechanism 10. In this manner the mechanism 10 may be operated in a number of modes included continuously, on demand, for a length of time, for a count or for combinations thereof.

Thus there has been shown and described a novel ball releasing mechanism which fulfills all the objects and advantages sought therefore. Many changes, modifications, variations and other uses and applications of the subject invention will, however, become apparent to those skilled in the art after considering this Specification together with the accompanying drawings and claims. All such changes, modifications, variations and other uses and applications which do not depart from the spirit and scope of the invention are deemed to be covered by the invention which is limited only by the claims which follow.

What is claimed is:

1. An automated feeder for connection between a source of balls and a ball propelling machine including:

a chute for guiding balls from the source of balls to the ball propelling machine having:

an upper end for connection to the source of balls; and a lower end for connection to the ball propelling machine;

a blocker positioned in said chute to obstruct movement of balls through said chute; and means to lift a ball being obstructed by said blocker over said blocker so that the ball can continue through said chute out said lower end to the ball propelling machine, said blocker including:

an upstanding linear abutment surface positioned to engage a ball moving through said chute;

a radius surface connected to said upstanding linear abutment surface; and an upper surface connected to said radius surface, said means to lift a ball being obstructed by said blocker over said blocker lifting the ball up said upstanding linear abutment surface, along said radius surface, and along said upper surface before release out said lower end to the ball propelling machine.

2. An automated ball feeder for connection between a source of balls and a ball propelling machine to controllably feed balls from the source of balls to the ball propelling machine, said automated ball feeder including:

a chute canted in a range of 20° to 30° from horizontal with respect to gravity, said chute having:

an upper end for connection to the source of balls; and a lower end for connection to the ball propelling machine;

a blocker positioned to obstruct movement of balls down said chute, said blocker having opposite sides; and means to move a ball being obstructed by said blocker over said blocker so that the ball can continue down said chute and out said lower end to the ball propelling machine, said means including:

a pair of rotatable hooks positioned on said opposite sides of said blocker in position, when rotated, to engage the underside of a ball positioned in said chute against said blocker and thereafter upon further rotation lift the ball over said blocker; and means to rotate said pair of rotatable hooks.

3. The automated ball feeder as defined in claim 2 wherein said chute further includes:

a slotted portion up through which said pair of rotatable hooks move during a portion of its rotation.

4. The automated ball feeder as defined in claim 2 wherein said chute further includes:

a semicircular cross-section portion adjacent said means to move a ball being obstructed by said blocker over said blocker; and a circular cross-section portion having a predetermined cross-sectional radius just larger than the radii of balls to be released by said automated ball feeder and being spaced about two of said predetermined cross-sectional radii from said means to move a ball being obstructed by said blocker over said blocker.

5. The automated feeder defined in claim 4 wherein said drive means to rotate said rotatable shaft include:

switch means for stopping rotation of said drive means; and shaft rotation position sensing means operatively connected to said switch means to cause said switch means to stop said drive means when said pair of rotatable hooks are pointed generally upwardly.

6. The automated feeder defined in claim 5 wherein said blocker includes:

an upstanding abutment surface positioned to engage a ball moving down said chute;

a radius surface connected to said upstanding abutment surface; and an upper surface connected to said radius surface, said pair of rotatable hooks cradling and lifting the obstructed ball up said upstanding abutment surface, over said radius surface, and along said upper surface before release down said chute and out said lower end to the ball propelling machine.

7. The automated feeder defined in claim 4 wherein said semicircular cross-section portion includes:

a center of cross-section, and wherein said blocker includes:

an upstanding linear abutment surface positioned in said chute and extending above said center of cross-section of said second chute portion to engage a ball moving down said chute.

8. The automated feeder defined in claim 7 wherein said means to rotate said pair of rotatable hooks includes:

a rotatable shaft to which said pair of rotatable hooks are connected, said rotatable shaft extending transversely across said chute behind said upstanding linear abutment surface.

9. An automated feeder for connection between a source of balls and a ball propelling machine including:

a chute for guiding balls from the source of balls to the ball propelling machine having:

an upper end for connection to the source of balls; and a lower end for connection to the ball propelling machine;

a blocker positioned in said chute to obstruct movement of balls through said chute; and means to lift a ball being obstructed by said blocker over said blocker so that the ball can continue through said chute out said lower end to the ball propelling machine, said means including:

a pair of rotatable hooks positioned on opposite sides of said blocker in position, when rotated, to engage the underside of a ball positioned in said chute against said blocker and thereafter upon further rotation lift the ball over said blocker.

10. The automated feeder defined in claim 9 wherein said means to lift a ball being obstructed by said blocker over said blocker further include:

a rotatable shaft to which said pair of rotatable hooks are connected, said shaft extending transversely across said chute behind at least a portion of said blocker; and drive means to rotate said rotatable shaft, said drive means including:

shaft rotation position sensing means which signal when said pair of rotatable hooks are pointed generally upwardly.

11. The automated feeder defined in claim 10 wherein said blocker includes:

an upstanding linear abutment surface positioned to engage a ball moving through said chute;

a radius surface connected to said upstanding linear abutment surface; and an upper surface connected to said radius surface, said pair of rotatable hooks cradling and lifting the ball obstructed by said blocker up said upstanding linear abutment surface, along said radius surface, and along said upper surface before release out said lower end to the ball propelling machine.

12. An automated feeder for connection between a source of balls and a ball propelling machine including:

a chute for guiding balls from the source of balls to the ball propelling machine having:

an upper end for connection to the source of balls; and a lower end for connection to the ball propelling machine;

a blocker positioned in said chute to obstruct movement of balls through said chute; and means to lift a ball being obstructed by said blocker over said blocker so that the ball can continue through said chute out said lower end to the ball propelling machine, wherein said chute further includes:

a first chute portion positioned toward said upper end, said first chute portion having a circular cross-section of a radius just larger than the radii of the balls which are to be released thereby; and a second chute portion having:

a cross-section center; and a semicircular cross-section of a radius just larger than the radii of the balls which are to be released thereby, said second chute portion being positioned between said first chute portion and said blocker, wherein said blocker includes:

an upstanding linear abutment surface positioned in said chute and extending above said cross-section center of said second chute portion to engage a ball moving through said chute, and wherein said means to lift a ball being obstructed by said blocker over said blocker include:

a pair of rotatable hooks positioned on opposite sides of said upstanding linear abutment surface, said pair of rotatable hooks, when rotated, engaging the underside of a ball positioned in said chute against said upstanding linear abutment surface and thereafter upon further rotation lifting the ball over said blocker; and a rotatable shaft to which said pair of rotatable hooks is connected, said rotatable shaft extending transversely across said chute between said upstanding linear abutment surface and said lower end.

13. The automated feeder defined in claim 12 wherein said hooks each have a radius of curvature which is at least as large as said cross-section radius of said second chute portion and each extend outwardly from said rotatable shaft a length that is less than three times said cross-section radius of said second chute portion.

* * * * *